United States Patent [19]

LaGrange

[11] 4,406,582

[45] Sep. 27, 1983

[54] SUBMERSIBLE PUMP DISCHARGE HEAD

[75] Inventor: Nyle D. LaGrange, Bettendorf, Iowa

[73] Assignee: Marley-Wylain Company, Mission, Kans.

[21] Appl. No.: 265,056

[22] Filed: May 19, 1981

[51] Int. Cl.[3] ..... F04D 29/42

[52] U.S. Cl. ..... 415/214; 415/200; 415/501; 220/67; 220/71; 220/210

[58] Field of Search ..... 415/200, 214, 501; 220/66, 67, 85 P, 210, 71, 73, 453; 137/382, 454.4; 194/54; 292/333; 200/65; 74/527; 70/20, 467

[56] References Cited

U.S. PATENT DOCUMENTS

| | | | |
|---|---|---|---|
| 1,132,598 | 3/1915 | Mershimer | 220/210 |
| 2,218,033 | 10/1940 | Thomsen | 220/67 |
| 2,315,228 | 3/1943 | Schulz | 220/67 |
| 2,385,450 | 9/1945 | Koppel | 220/67 |
| 2,470,057 | 5/1949 | Spender | 220/39 |
| 3,098,578 | 7/1963 | Rudelick | 220/66 |
| 3,381,617 | 5/1968 | Wright | 415/200 |
| 3,521,970 | 7/1970 | Deters | 415/501 |
| 3,612,716 | 10/1971 | Deters | 415/140 |
| 3,815,776 | 6/1974 | MacMillan | 220/39 R |
| 4,120,606 | 10/1978 | Reiss | 415/199.1 |
| 4,142,756 | 3/1970 | Henning et al. | 296/1 C |

FOREIGN PATENT DOCUMENTS

| | | | |
|---|---|---|---|
| 1016942 | 11/1952 | France | 220/71 |

*Primary Examiner*—Stephen Marcus
*Assistant Examiner*—John Kwon
*Attorney, Agent, or Firm*—Schmidt, Johnson, Hovey & Williams

[57] ABSTRACT

A discharge head for a submersible pump includes a plastic body having an internally threaded neck for receiving a tapered threaded end of a fluid delivery pipe and a metal shell surrounding and engaging the neck to reinforce the neck against the radial forces developed by the tapered end of the pipe as it is tightened. An annular shoulder extends radially outward and downward from the neck and includes a pair of apertured lugs, each having a pair of laterally extending detents. The shell includes a shoulder corresponding to the annular shoulder and a pair of slots for receiving the lugs and for snapping down over the detents to aid in retaining the shell on the body. In one embodiment of the invention, a skirt extends downwardly from the annular shoulder and includes threads for connection with corresponding threads on a casing of the pump section of the pump. In an alternate embodiment, a flange extends downwardly from the shoulder of the discharge head shell along the skirt and defines the threads that mate with the threads of the pump section casing.

2 Claims, 6 Drawing Figures

SUBMERSIBLE PUMP DISCHARGE HEAD

BACKGROUND OF THE INVENTION

This invention relates to a submersible pump and, more particularly, to a submersible pump discharge head which is strong, non-corrosive and inexpensive to produce.

It is known in the prior art to construct submersible pumps having discharge heads made from castings of iron, brass or other metals. Such metal castings were slow and expensive to produce, and they required machining. Furthermore, they were heavy and were subject to corrosion from the fluids being pumped, including corrosion from the water in wells in which many of the submersible pumps were used. Although some metals, such as brass, were more resistant to corrosion than other metals, they were also more expensive than the other metals. In addition, since the discharge heads were often connected to supporting drop pipes or delivery pipes of a dissimilar metal, galvanic couples were created between the discharge heads and the delivery pipes, causing an electric current to flow which eroded the heads and the pipes. As a result, some additional structure, such as dielectric bushings, were required to prevent the galvanic erosion of the discharge heads and the delivery pipes.

In order to overcome the shortcomings of metal discharge heads, it has heretofore been proposed to make the discharge heads of a plastic material. Although the plastic discharge heads did overcome many of the problems associated with the metal discharge heads, the plastic discharge heads were unable to withstand the forces exerted on them when they were connected to the delivery pipe. This is largely due to the fact that a threaded connection is generally used between a plastic discharge head and the delivery pipe in which the threaded end of the delivery pipe is tapered so that, as the delivery pipe is screwed farther into the threads of the discharge head, the connection becomes tighter and tighter so as to form a fluid tight seal. Thus, such a tapered threaded connection eliminates the need for a separate seal between the delivery pipe and the discharge head. However, tremendous forces, especially in the radial direction, are exerted on the discharge head during the tightening of such a tapered threaded connection, so that in many instances, the plastic discharge heads have cracked or otherwise failed under the forces.

SUMMARY OF THE INVENTION

It is therefore an object of the present invention to provide a discharge head which exhibits the desirable properties of a plastic discharge head, such as corrosion resistance, fluid tight sealing with the delivery pipe, and low cost, while providing high strength and resistance to failure, especially under the radial forces exerted by the tightening of the tapered threads of the drop pipe in the receiving threads of the discharge head.

Toward the fulfillment of these and other objects, the discharge head of the present invention includes a plastic body having an internally threaded neck for receiving external threads on the tapered end of the delivery pipe and a high strength shell of, for example, metal external to the body, surrounding the neck and reinforcing it, especially against radially directed forces. The body further includes an annular shoulder extending radially outward from the neck and a skirt extending downward from the outer perimeter of the shoulder for connection to the pump casing. The discharge head body further includes one or more apertured lugs connected to the annular shoulder, the lugs including detents which co-operate with the discharge head shell. The discharge head shell has a shoulder which corresponds to the annular shoulder of the body and includes one or more slots for receiving the lugs and snapping over the detents to aid in retaining the discharge head shell on the discharge head body. In an alternate embodiment, the apertured lugs are omitted from the discharge head body and are attached to the discharge head shell.

DETAILED DESCRIPTION OF THE PREFERRED EMBODIMENT

Figure 1:
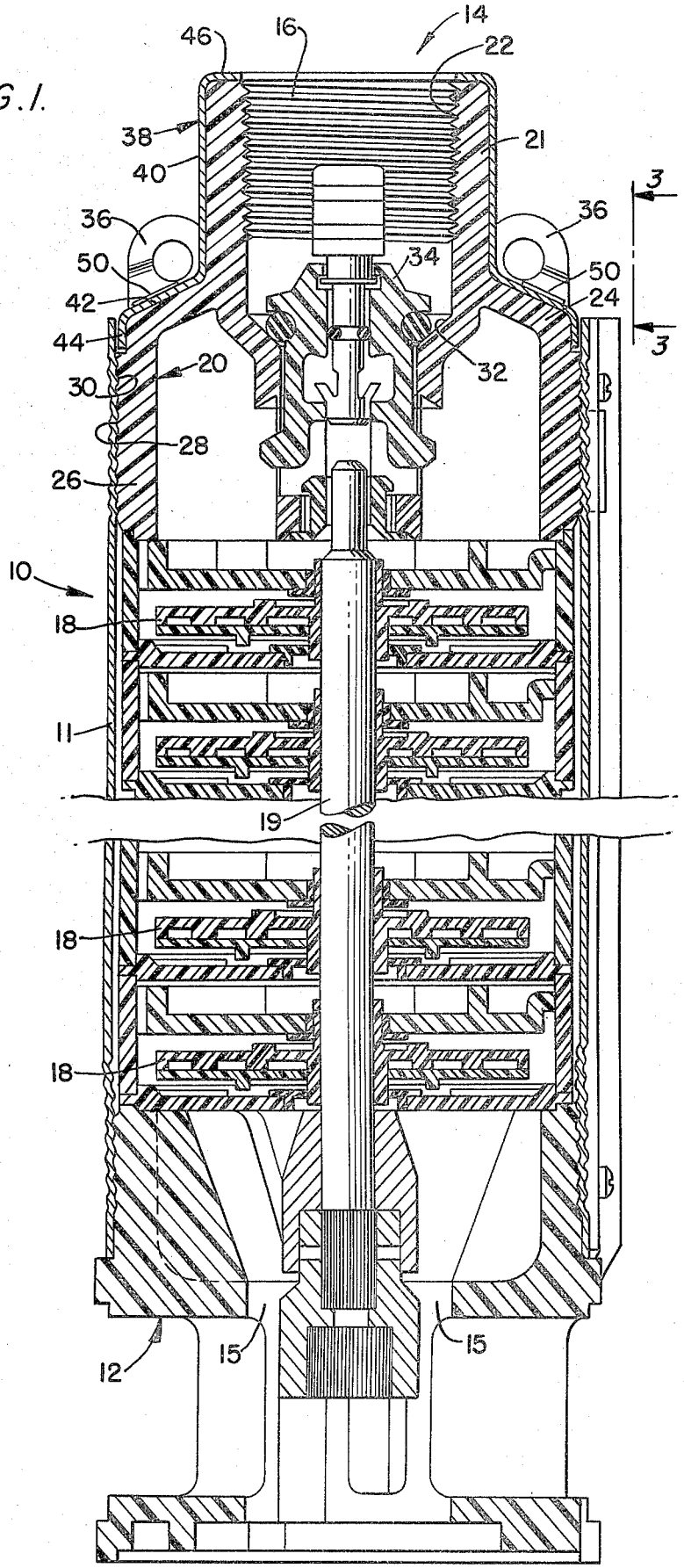
FIG. 1 is a cross section of the pump section of a submersible pump employing a discharge head according to the present invention.

Referring to FIG. 1 of the drawings, the reference numeral 10 refers in general to a pump section of a submersible pump assembly which includes a casing 11 connected between an inlet head 12 and a discharge head 14. The inlet head 12 includes a plurality of inlet openings 15 for receiving the fluid to be pumped, and the discharge head 14 includes an outlet opening 16 for discharging the fluid. The pump section 10 includes a plurality of pumping elements, such as impellers 18 mounted within the casing 11 and driven by a shaft 19. The shaft 19 is coupled to the shaft of a motor (not shown) which is attached to the lower end of the pump section 10 as viewed in the drawings. Liquid enters the bottom of the pump section 10 and is forced by the impellers 18 up through the casing 11 and out through the discharge head 14. The entire pump assembly is supported in the vertical position shown in a well or the like by a drop pipe or delivery pipe (not shown) which attaches to the discharge head 14 and extends upward to the surface.

The discharge head 14 includes a plastic body 20 having a neck 21 which defines a hexagonal outer surface and contains internal threads 22 for receiving a tapered threaded end of the delivery pipe. The body 20 further includes an annular shoulder 24 extending radially outward from the lower end of the neck 21 and sloping slightly downward. A skirt 26 extends downward from the outer periphery of the annular shoulder 24 and includes external threads 28 for mating with complementary threads 30 defined in the casing 11. The discharge head body 20 also defines an interior annular valve seat 32 which supports and co-operates with a check valve 34, which is fully described in an associated copending application entitled "Submersible Pump Check Valve" Ser. No. 292,049, pending, and assigned to the assignee of the present application.

A pair of apertured lugs 36 are integrally formed with the annular shoulder 24 and the lower end of the neck 21. The apertured lugs 36 are designed to receive a safety rope which is attached at its other end to a well adapter at the top of the well. In the event of any failure of the connection between the delivery pipe and the discharge head 14, or at times of installation or removal, the safety rope prevents the pump from falling into the well. Although a pair of apertured lugs 36 is illustrated, it is understood that any number of lugs can be employed.

The discharge head body 20 is made from a lightweight, non-corrosive plastic material, such as nylon or other materials available under the tradenames Zytel and Celcon. It is contemplated using a discharge head body 20 in which one of the aforementioned materials is glass-filled. Such materials are chosen for their impact strength, tensile strength, minimal water absorption and their resilience at temperature extremes, as well as for their corrosion resistance and their ability to form a fluid tight seal with the threaded delivery pipe.

The discharge head 14 also includes a high-strength shell 38 made from a material having greater strength than the material of the body 20 surrounding the neck 21 of the body 20 and engaging the body, thereby reinforcing the body against stresses, particularly in the radial direction. As can best be seen from FIGS. 1, 4 and 5, the shell 38 includes a hexagonal portion 40 which has an inner surface complementary to the hexagonal outer surface of the neck 21. A shoulder 42 extends radially outward and downward from the lower end of the hexagonal portion 40 and corresponds to the annular shoulder 24 of the body 20. A flange 44 extends downward from the outer periphery of the shoulder 42 in engagement with an upper portion of the skirt 26, and an inwardly directed flange 46 covers the top of the neck 21 of the body 20. The shell 38 is received on the body 20 in a force fit, which helps keep the shell and the body together, while prestressing the neck 21 radially inward in reinforcement against radially outward directed forces. The shell 38 is preferably made from a non-corrosive metal, such as stainless steel, which is capable of withstanding substantial stress.

Figure 2:
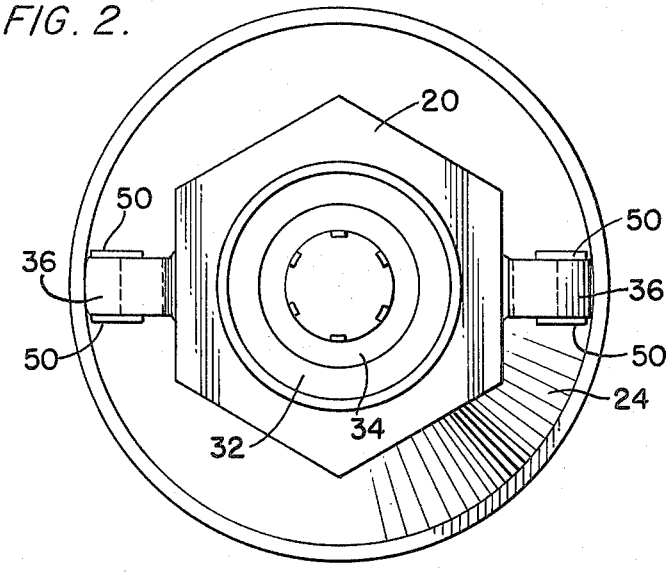
FIG. 2 is a plan view of the discharge head body of FIG. 1.
Figure 3:
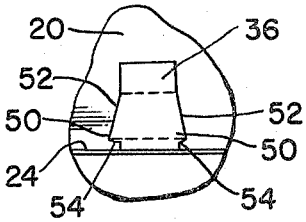
FIG. 3 is an end view taken along the line 3—3 in FIG. 1 of one of the apertured lugs of FIG. 2.
Figure 4:
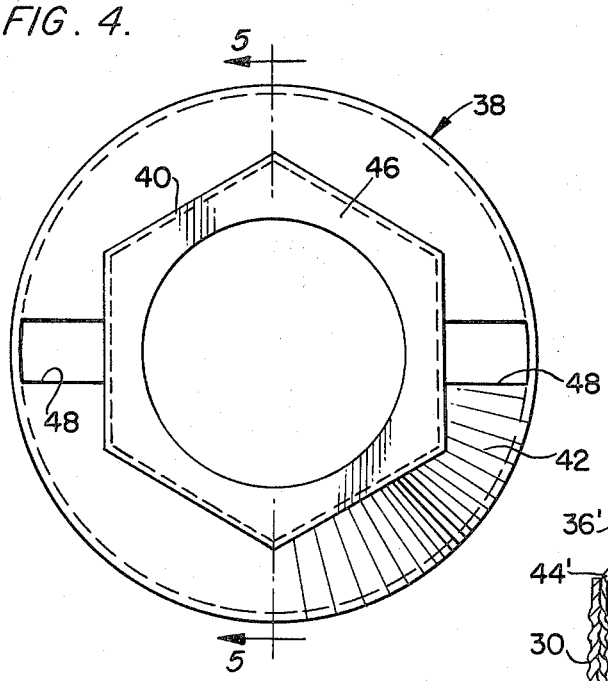
FIG. 4 is a plan view of the discharge head shell of FIG. 1.
Figure 5:
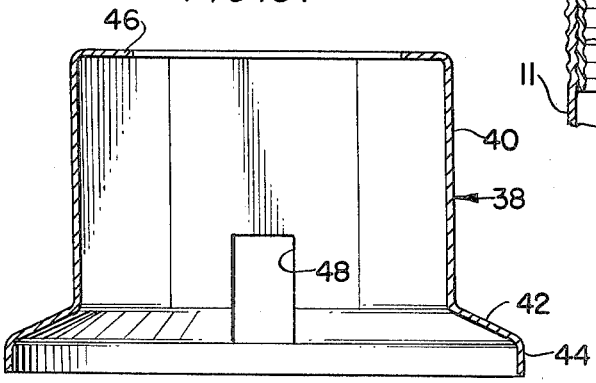
FIG. 5 is a cross section taken along the line 5—5 in FIG. 4.

As is best illustrated in FIGS. 4 and 5, the shell 38 includes a pair of slots 48 defined in the shoulder 42 and the lower end of the hexagonal portion 40 for receiving the lugs 36. As can be seen from FIGS. 2 and 3, each lug 36 includes a pair of laterally extending resilient detents 50, each of which includes a gently flaring side surface 52 and a downwardly facing ledge 54 positioned close to the annular shoulder 24. The width of each slot 48 is greater than the width of the lugs 36 at their top and bottom but less than the width of the lugs 36 at the detents 50. As a result, when the discharge head shell 38 is forced down over the body 20, the material of the shell 38 defining the slots 48 deforms the detents 50 inwardly until it passes the lower ends of the detents 50, at which point the detents 50 snap outwardly, the ledges 54 holding the shoulder 42 of the shell 38 in contact with the annular shoulder 24 of the body 20.

Figure 6:
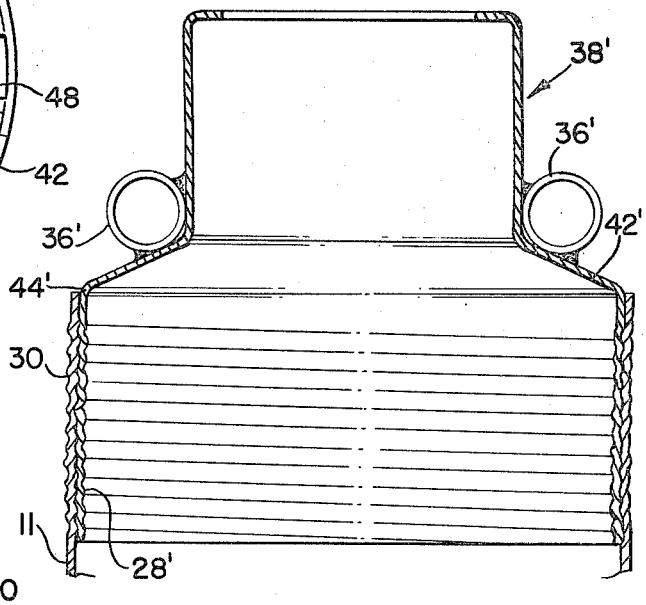
FIG. 6 is a cross section of an alternate form of the discharge head shell according to the present invention, attached to a submersible pump casing.

In an alternate embodiment of the discharge head according to the present invention, as illustrated in FIG. 6, the downward extending flange 44' of the discharge head shell 38' is lengthened to be substantially coextensive with the skirt of the discharge head body. In addition, threads 28' are formed in the flange 44' rather than in the skirt to mate with the threads 30 in the casing 11. Furthermore, as an alternative to the lug structure previously described, the lugs on the discharge head body have been eliminated, and metal lugs 36' comprising loops are welded to the shoulder 42' to receive the safety rope.

When a delivery pipe having a tapered threaded end is screwed into the threaded neck 21 of the discharge head body 20 of the present invention, the hexagonal portion 40 of the discharge head shell 38 reinforces the neck 21 to absorb the increasing radial forces that develop as the delivery pipe is screwed tight enough to form a fluid tight seal with the threads 22 of the neck 21. In addition, the shape of the hexagonal portion 40 of the shell 38 and the hexagonal outer surface of the neck 21 permit a wrench to be applied to the discharge head 14 to prevent rotation of the discharge head while the delivery pipe is screwed into place. The discharge head shell 38 also protects the discharge head body 20 from chipping or cracking under any external impacts.

Although it is apparent from the foregoing that the present invention is well adapted for improving the performance of discharge heads in submersible pumps, it is understood that various changes and modifications may be made without departing from the spirit and scope of the present invention as recited in the appended claims and their legal equivalents.

What is claimed is:

1. A removable discharge head for coupling a submersible pump casing to a fluid delivery line comprising:

a neck portion having a generally cylindrical, threaded inner surface adapted for threadably receiving said fluid delivery line and defining a centered axis;

an annular shoulder extending radially outwardly from said neck portion, said shoulder including an apertured lug operably coupled thereto;

a generally cylindrical skirt axially depending from said shoulder and including means for detachable coupling of said skirt with said casing, said neck portion, shoulder and skirt each including an outer surface having respective diameters; and an outer shell having an inner surface with a portion complemental to said neck portion, said shell inner surface portion having a diameter smaller than the diameter of said neck outer surface, whereby said neck is tightly received within said shell in a force fit, thereby protecting said neck portion, and supporting said neck portion against radially outwardly directed forces generated when said delivery line is received by said threaded inner surface, said shell inner surface including additional portions complemental to said shoulder and skirt outer surfaces, said additional portions having a diameter smaller than the respective diameters of said shoulder and skirt outer surfaces, whereby said shoulder and skirt are received within said shell in a force fit, said shell further including structure defining a slot for receiving said lug therethrough, and said lug including a body having a top portion and bottom portion being of a lesser width than the width of said slot, and a pair of opposed detents spaced apart from said shoulder and extending outwardly from said body, the cross section of said lug at said detents being of a greater width than said slot, said shell being interposed between and retained by said shoulder and said detents.

2. A removable discharge head as set forth in claim 1, said neck portion outer surface, and said corresponding portion of said shell, being polygonal.

* * * * *